US009306311B2

(12) United States Patent
Kitajima et al.

(10) Patent No.: US 9,306,311 B2
(45) Date of Patent: Apr. 5, 2016

(54) CONNECTOR

(71) Applicant: Sumitomo Wiring Systems, Ltd., Yokkaichi (JP)

(72) Inventors: Mitsunori Kitajima, Yokkaichi (JP); Shigeto Kataoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/322,423

(22) Filed: Jul. 2, 2014

(65) Prior Publication Data

US 2015/0031230 A1 Jan. 29, 2015

(30) Foreign Application Priority Data

Jul. 26, 2013 (JP) ..... 2013-155976

(51) Int. Cl.
*H01R 13/514* (2006.01)
*H01R 13/436* (2006.01)
*H01R 13/422* (2006.01)

(52) U.S. Cl.
CPC ..... *H01R 13/4367* (2013.01); *H01R 13/4223* (2013.01)

(58) Field of Classification Search
USPC ..... 439/752, 595
IPC ..... H01R 13/4223,13/4365, 13/4362, 13/4368
See application file for complete search history.

(56) References Cited

U.S. PATENT DOCUMENTS

| | | | | |
|---|---|---|---|---|
| 6,589,083 | B2 * | 7/2003 | Kobayashi et al. | 439/752 |
| 6,811,451 | B2 * | 11/2004 | Mase et al. | 439/752 |
| 7,252,547 | B2 * | 8/2007 | Nishide | 439/587 |
| 8,449,319 | B2 * | 5/2013 | Fujii et al. | 439/489 |

FOREIGN PATENT DOCUMENTS

| | | |
|---|---|---|
| JP | 2005-123078 | 5/2005 |

* cited by examiner

*Primary Examiner* — Hien Vu
(74) *Attorney, Agent, or Firm* — Gerald E. Hespos; Michael J. Porco; Matthew T. Hespos

(57) ABSTRACT

A connector includes a housing (10), terminal fittings (30) to be inserted into the housing (10), a retainer (20) configured to retain the terminal fittings (30) by being mounted into the housing (10) in a direction intersecting an inserting direction of the terminal fittings (30), resilient locks (25) formed on a base end of the retainer (20) in a mounting direction into the housing (10) and configured to hold the retainer (20) in a state mounted in the housing (10) by being locked to the housing (10). Slide-contact portions (28) formed on a tip side of the retainer (20) in the mounting direction into the housing (10) and extending parallel to the mounting direction of the retainer (20), and guides (16) formed in the housing, extending parallel to the mounting direction of the retainer (20) and to be brought into sliding contact with the slide-contact portions (28).

6 Claims, 7 Drawing Sheets

CONNECTOR

BACKGROUND

1. Field of the Invention

The invention relates to a connector.

2. Description of the Related Art

Japanese Unexamined Patent Publication No. 2005-123078 discloses a connector in which a terminal fitting is inserted into a housing and retained by a retainer mounted into the housing. The retainer includes two resiliently deformable holding pieces spaced apart in a direction intersecting a mounting direction into the housing. The holding pieces lock to the housing to hold the retainer in the housing. This connector also includes two connection means for preventing backlash of the retainer relative to the housing. One connection means is on a base end of the retainer in the mounting direction into the housing and is connected to the housing. The other connection means is on a tip of the retainer in the mounting direction and is connected to the housing.

The connection means on the tip of the retainer is configured by the two holding pieces. These holding pieces are resiliently deformable. Thus, the retainer may be inclined in the process of being mounted into the housing. An inclined retainer may not lock the holding pieces to the housing correctly.

The invention was completed based on the above situation and aims to reliably prevent a retainer from being inclined with respect to a housing.

SUMMARY OF THE INVENTION

The invention is directed to a connector with a housing, a terminal fitting to be inserted into the housing and a retainer configured to retain the terminal fitting by being mounted into the housing in a direction intersecting an inserting direction of the terminal fitting. Two resilient lock pieces are formed on a base end part of the retainer in a mounting direction into the housing and are configured to hold the retainer mounted in the housing by being locked to the housing. A slide-contact portion is formed on a tip of the retainer in the mounting direction into the housing and extends parallel to the mounting direction of the retainer. A guide is formed in the housing and extends parallel to the mounting direction of the retainer. The guide can be brought into sliding contact with the slide-contact portion.

According to this configuration, the slide-contact portion slides in contact with the guide in the process of mounting the retainer into the housing and prevents inclination of the retainer. This can avoid a situation where the resilient lock pieces and the housing are not locked correctly to each other due to inclination of the retainer. Further, the slide-contact portion and the resilient lock pieces are arranged at mutually different positions in the mounting direction. Thus, a degree of design freedom is high in forming the slide-contact portion and the resilient lock pieces.

The retainer preferably includes a main body with a retaining portion for locking the terminal fitting and an operating portion cantilevered in a direction intersecting the mounting direction from a base end of the main body. The resilient lock pieces are cantilevered from the operating portion and are parallel to the mounting direction. According to this configuration, the resilient lock pieces are held in correct postures and are locked reliably to the housing if the operating portion is pushed in a correct direction when the resilient lock pieces are locked to the housing in the process of mounting the retainer.

The retainer includes a main body with a retaining portion for locking the terminal fitting and an operating portion cantilevered from a base end of the main body and extending in a direction intersecting the mounting direction. The slide-contact portion is in the form of a rib projecting from the main body and a projecting direction of the slide-contact portion is the same direction as an extending direction of the operating portion. According to this configuration, the operating portion and the slide-contact portion extend toward the same side from the main body. Thus, the retainer can be made smaller as compared with the case where the operating portion and the slide-contact portion extend toward opposite sides from the main body.

DETAILED DESCRIPTION OF THE PREFERRED EMBODIMENTS

A connector in accordance with the invention is illustrated in FIGS. 1 to 7 and is formed by assembling a housing 10 made of synthetic resin, a plurality of terminal fittings 30 and a retainer 20 made of synthetic resin.

Figure 3:
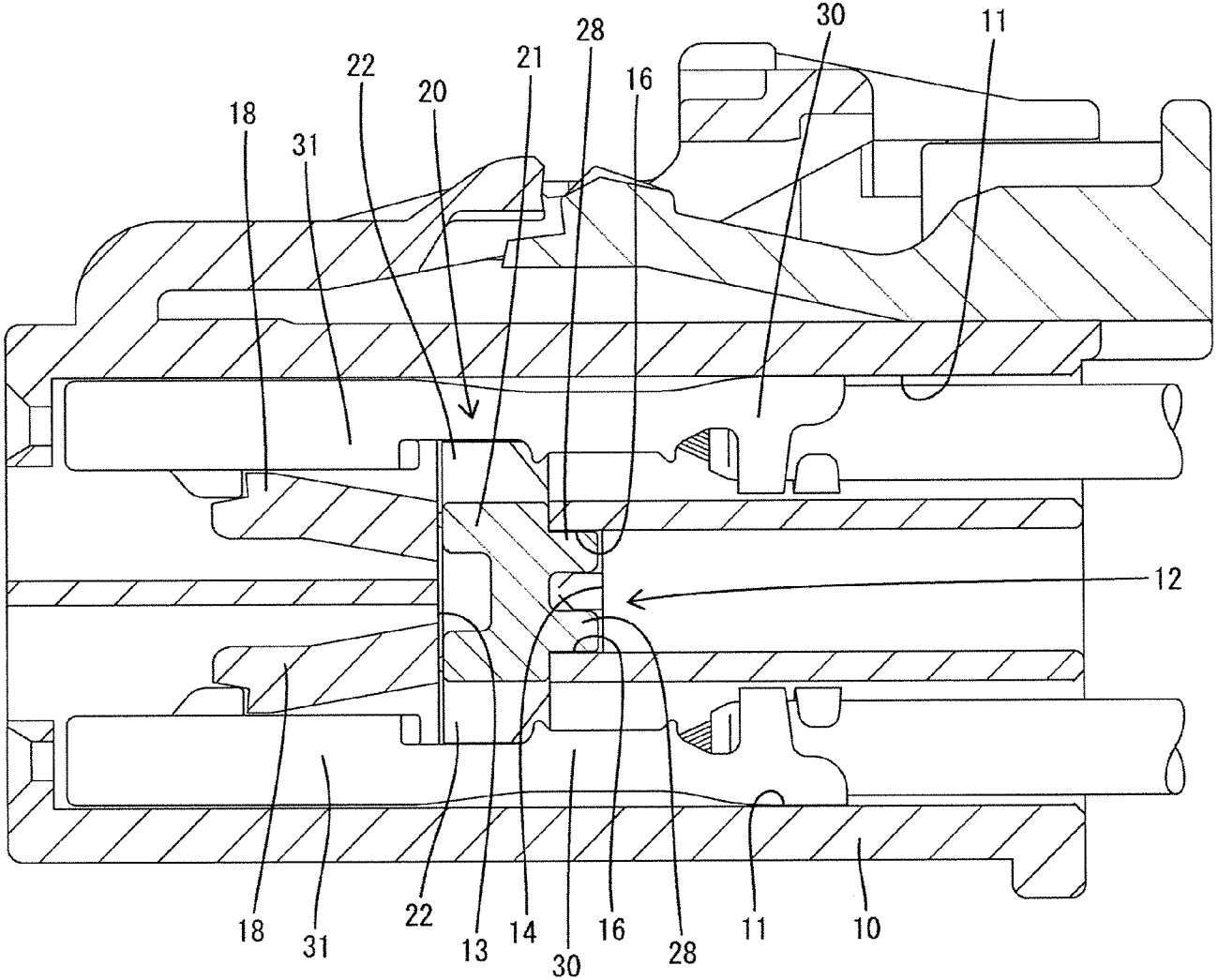
FIG. 3 is a section along B-B of FIG. 1.

As shown in FIG. 3, terminal housing chambers 11 are formed in upper and lower rows in the housing 10. The terminal fitting 30 is inserted into each terminal housing chamber 11 from behind the housing 10 (right side in FIG. 3) and are retained by the locking action of a locking lance 18. The terminal fitting 30 inserted into the terminal housing chamber 11 also is retained by the locking action of the retainer 20 to be described later.

Figure 2:
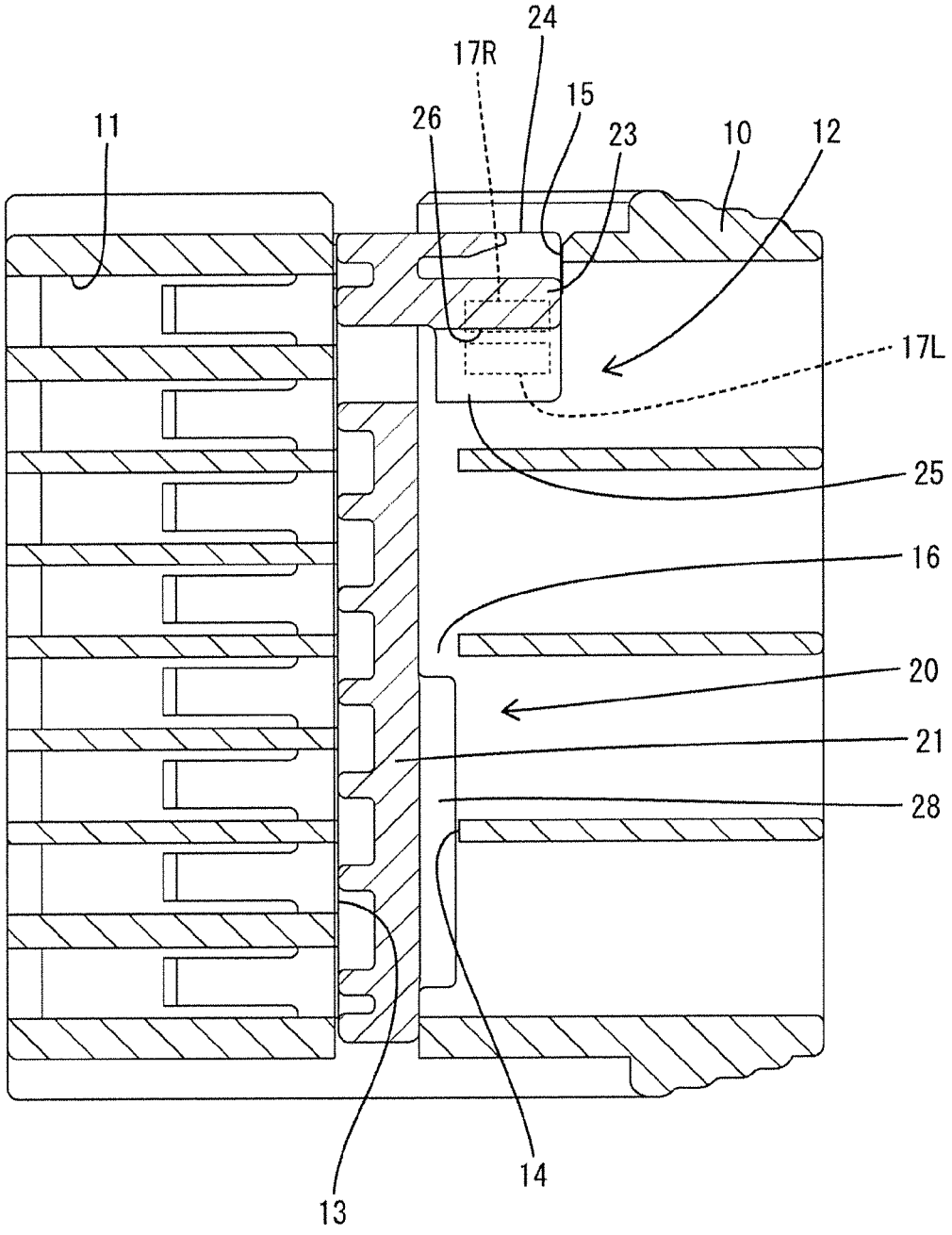
FIG. 2 is a section along A-A of FIG. 1.
Figure 5:
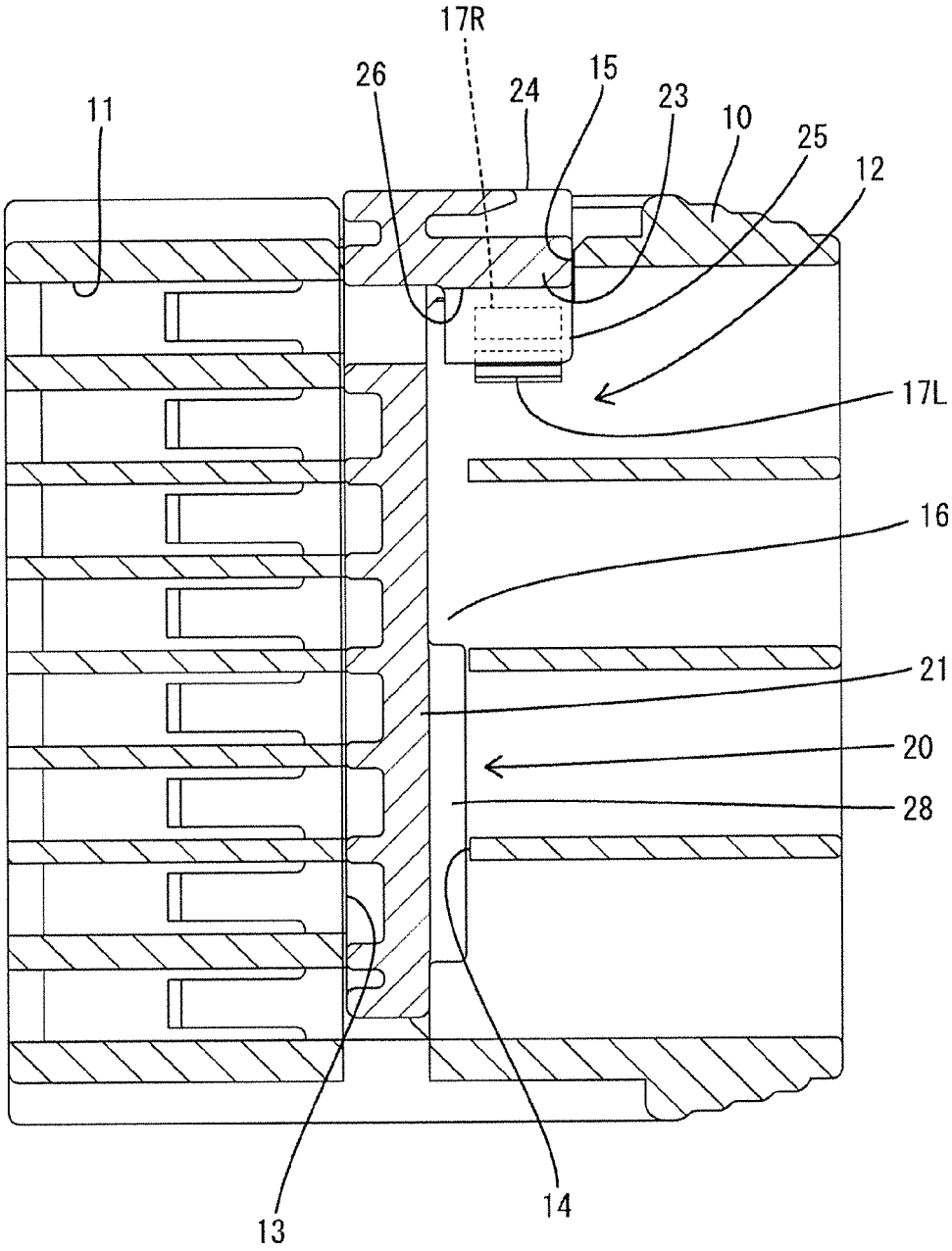
FIG. 5 is a section along C-C of FIG. 4.

As shown in FIGS. 2 and 5, a mounting hole 12 is formed in the housing 10 and is open on opposite left and right surfaces of the housing 10. An opening area of the mounting hole 12 on the right surface of the housing 10 is larger than that of the mounting hole 12 on the left surface of the housing 10. The mounting hole 12 comprises a first, second and third chambers 13, 14 and 15. The first chamber 13 has upper and lower parts that communicate with the terminal housing chambers 11. The second chamber 14 has a smaller height than the first chamber 13 and the third chamber 15 has substantially the same height as the second chamber 14. The first chamber 13 is long and narrow in a lateral direction from the right surface to the left surface of the housing 10. The first chamber 13 has a vertically long rectangular opening shape on the opposite left and right surfaces of the housing 10. A main body 21 and retaining portions 22 of the retainer 20 are housed in the first chamber 13.

The second chamber 14 communicates with the rear surface of the first chamber 13 and is long and narrow in the lateral direction. The right end of the second chamber 14 is open on the right surface of the housing 10, and the left end thereof is closed by an outer wall of the housing 10. As shown in FIG. 3, a cross-sectional shape of the second chamber 14, i.e. an opening shape on the right surface of the housing 10 is a vertically long rectangle. Centers of the first and second chambers 13 and 14 in a height direction are at the same height. The upper surface of the second chamber 14 is formed by bottom walls of the terminal housing chambers 11 in the upper row and the lower surface of the second chamber 14 is formed by upper walls of the terminal housing chambers 11 in the lower row. The upper and lower surfaces of the second chamber 14 function as upper and lower guides 16. The guides 16 extend straight in the lateral mounting direction of the retainer 20 into the housing 10. Slide-contacts 28 of the retainer 20 are housed into the second chamber 14.

Figure 1:
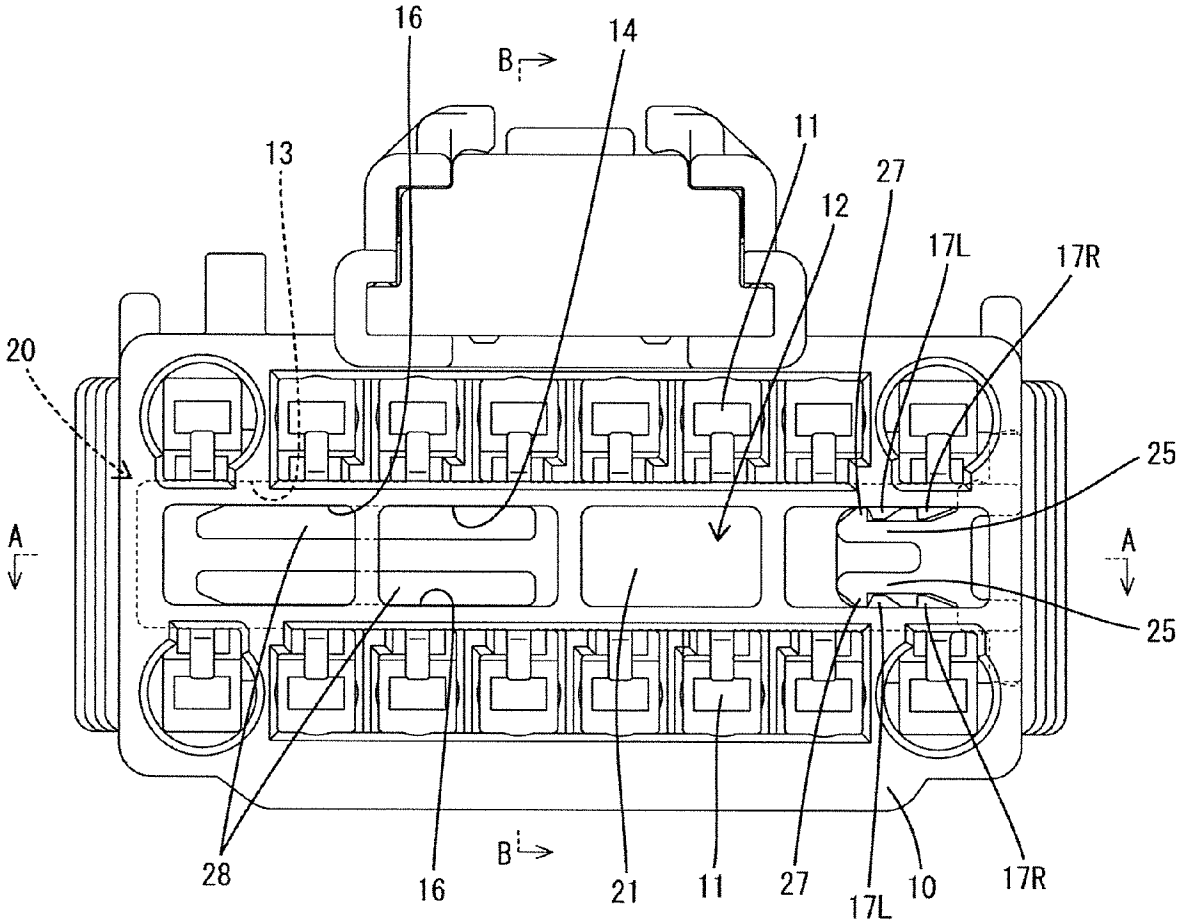
FIG. 1 is a rear view of a connector showing a state where a retainer is mounted at a full locking position in one embodiment.

A formation area of the third chamber 15 in the lateral direction is limited to only a right end part of the housing 10. The third chamber 15 communicates with the rear surface of the second chamber 14 and is open on the right surface of the housing 10. As shown in FIG. 5, an operating portion 23 and resilient lock pieces 25 of the retainer 20 are housed in the third chamber 15. As shown in FIG. 1, two locking projections 17L, 17R spaced apart in the lateral direction are formed on each of the upper and lower surfaces of the third chamber 15. The locking projections 17L, 17R on the upper surface and those on the lower surface are vertically symmetric.

Figure 6:
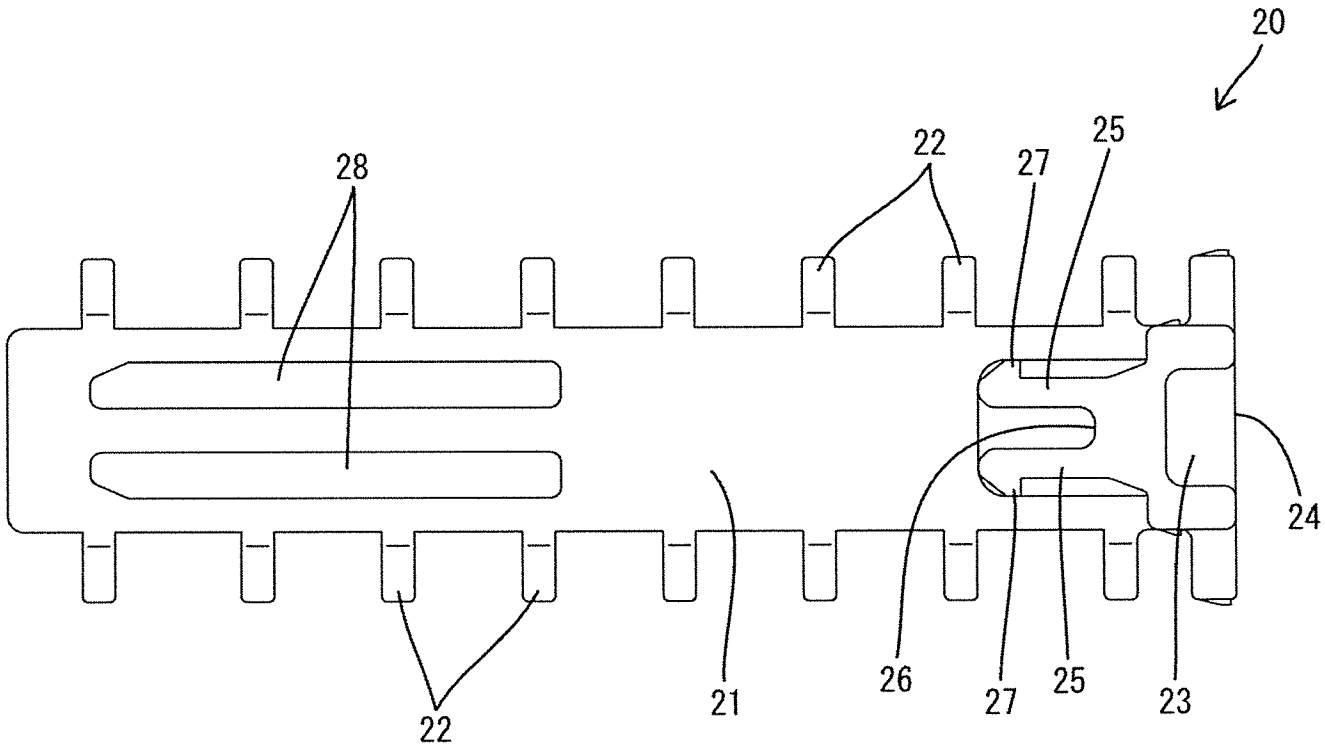
FIG. 6 is a rear view of the retainer.

As shown in FIGS. 1 and 2, the retainer 20 includes the main body 21 that is long and narrow in the lateral direction parallel to the mounting direction of the retainer 20 into the housing 10. As shown in FIG. 6, retaining portions 22 project up from the upper surface of the main body 21 and down from the lower surface of the main body 21. The retaining portions are laterally spaced to correspond to the terminal housing chambers 11.

Figure 7:
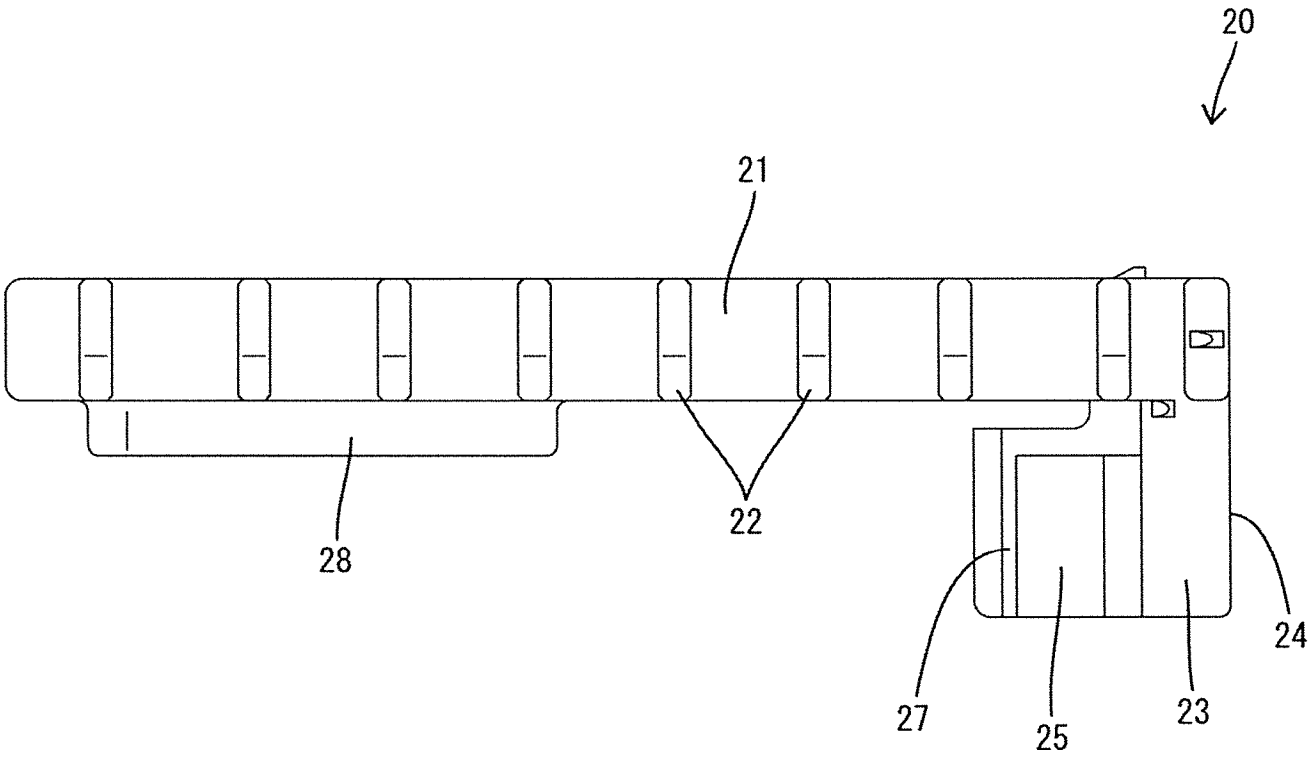
FIG. 7 is a plan view of the retainer.

As shown in FIGS. 6 and 7, the operating portion 23 is cantilevered back from a right end of the main body 21 to extend in direction at a right angle to the mounting direction of the retainer 20. The operating portion 23 is a rectangular plate and the right surface of the operating portion 23 defines a flat operating surface 24 to be pushed by an operator when mounting the retainer 20 into the housing 10. The operating surface 24 improves operability in mounting the retainer 20 into the housing 10.

Upper and lower resilient locks 25 are arranged on a base end part of the retainer 20 in the mounting direction for holding the retainer 20 in the housing 10. The resilient locks 25 are spaced apart in a vertical direction (direction perpendicular to the mounting direction of the retainer 20 and perpendicular to an inserting direction of the terminal fittings 30 into the housing 10). A deflection space 26 is defined between the resilient locks 25 and permits the resilient locks 25 to be deflected in the process of mounting the retainer 20. The resilient locks 25 are cantilevered leftward from the left surface of the operating portion 23. An extending direction of the resilient locks 25 is the same as the mounting direction of the retainer 20. Lock projections 27 are formed on extending end parts of the resilient locks 25 and project toward sides opposite to the deflection space 26.

Upper and lower slide-contacts 28 are formed in an area of the tip side of the retainer 20 in the mounting direction. The slide-contacts 28 are in the form of ribs projecting back from the rear surface of the main body 21 and extend straight in the lateral direction (i.e. parallel to the mounting direction of the retainer 20). A formation area of the slide-contacts 28 in the lateral direction is a range from a position near the left end of the retainer 20 (main body 21) to a substantially lengthwise center of the retainer 20 (main body portion 21). An extending direction of the slide-contacts 28 from the main body portion 21 is the same direction as that of the operating portion 23 from the main body 21.

The retainer 20 is mounted at a partial locking position with respect to the housing 10 prior to mounting the terminal fittings 30 into the housing 10. In mounting the retainer 20, the retainer 20 is inserted into the mounting hole 12 from the right side of the housing 10 with a left end part of the main body 21 in the lead. At this time, the main body 21 and the retaining portions 22 are fit into the first chamber 13 and the upper and lower slide-contacts 28 are fit into the second chamber 14. The retainer 20 is mounted further by pushing the operating surface 24.

Figure 4:
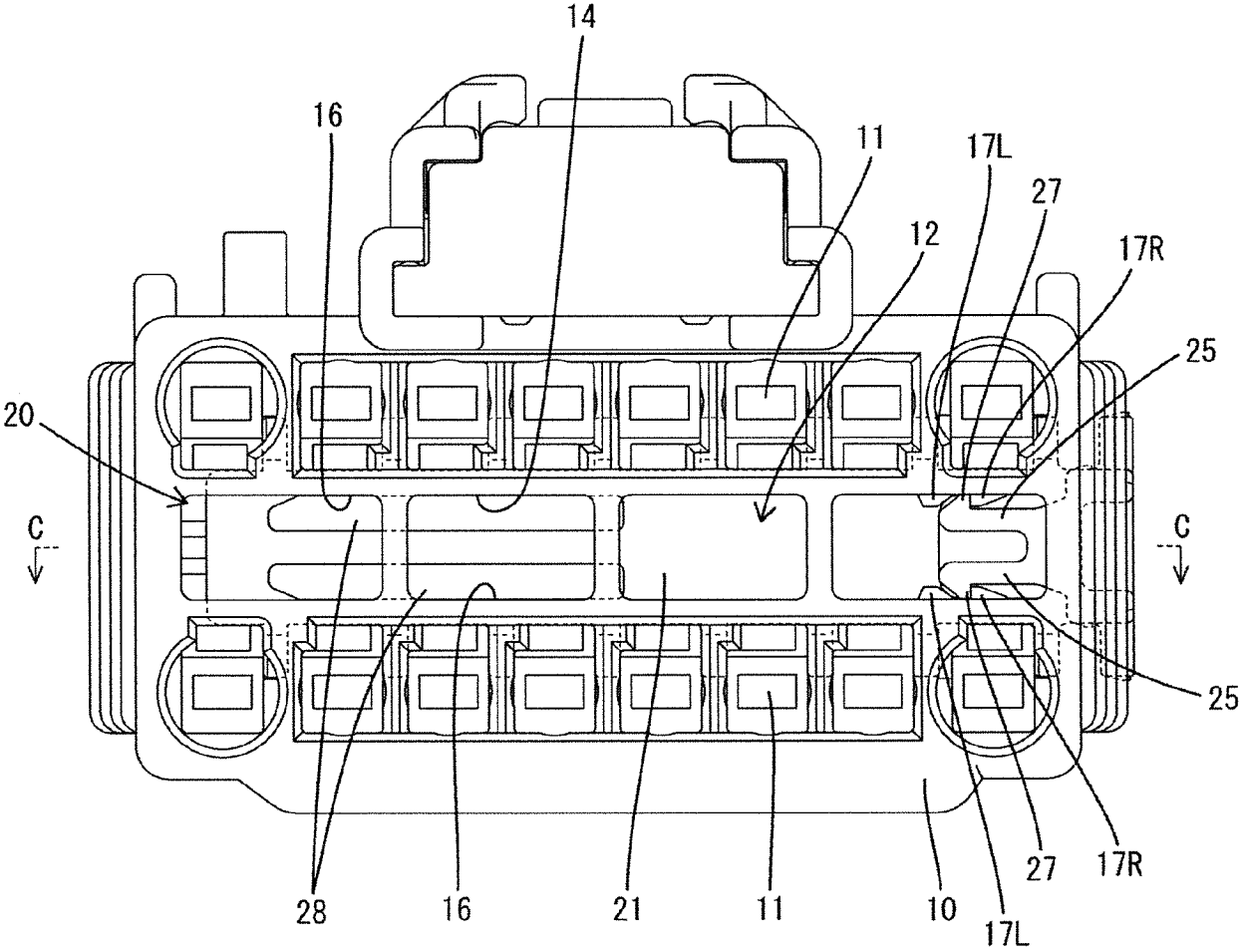
FIG. 4 is a rear view of the connector showing a state where the retainer is mounted at a partial locking position.

As shown in FIG. 4, in the process of mounting the retainer 20, the upper surface of the upper slide-contact 28 slides in contact with the upper guide 16 and the lower surface of the lower slide-contact 28 slides in contact with the lower guide 16, thereby restricting a relative vertical displacement and inclination of the retainer 20 with respect to the housing 10. Thus, the retainer 20 moves parallel while keeping a correct posture. Further, the operating portion 23 is formed with the operating surface 24 cantilevered backward from the main body portion 21. Thus, the retainer 20 may be inclined in the front-back direction by a leftward acting pressing force applied to the operating surface 24. However, the main body 21 slides in contact with both front and rear surfaces of the first chamber 13 so that the retainer 20 is not inclined in the front-back direction.

The operating portion 23 and the resilient locks 25 enter the third chamber 15 as the retainer 20 is mounted further. As the retainer 20 approaches the partial locking position, the lock projections 27 of the upper and lower resilient locks 25 interfere with the locking projections 17R and the resilient locks 25 resiliently deflect toward each other and enter the deflection space 26. The resilient locks 25 resiliently restore when the retainer 20 reaches the partial locking position and the lock projections 27 are fit into gaps between the adjacent left and right locking projections 17L, 17R, as shown in FIG. 4. The locking action of the lock projections 27 and the locking projections 17L, 17R holds the retainer 20 at the partial locking position and restricts relative lateral displacement.

The retaining portions 22 are at non-corresponding positions retracted rightward from the terminal fittings 30 when the retainer 20 is at the partial locking position. Thus, the terminal fitting 30 can be inserted into each terminal housing chamber 11. A pushing force exceeding a locking force of the locking projections 17L, 17R and the lock projections 27 is applied to the operating surface 24 after the terminal fittings 30 are inserted into the terminal housing chambers 11. The resilient lock pieces 25 then deflect resiliently and the retainer 20 moves from the partial locking position to a full locking position. The lock projections 27 are locked to the left locking projections 17L from the left side when the retainer 20 moves to the full locking position, and this locking action holds the retainer 20 at the full locking position, as shown in FIG. 1.

The retaining portions 22 are locked to rectangular tubes 31 of the terminal fittings 30 from behind with the retainer 20 at the full locking position, and this locking action retains the terminal fittings 30. Thus, the terminal fittings 30 are held reliably in a retained state by primary locking action by the locking lances 18 and secondary locking action by the retainer 20. Further, the slide-contacts 28 slide in contact with the guides 16 when the retainer 20 moves from the partial locking position to the full locking position. Thus, a vertical inclination of the retainer 20 is restricted.

The connector of this embodiment includes the retainer 20 for retaining the terminal fittings 30 by being mounted into the housing 10 in the direction intersecting with the inserting direction of the terminal fittings 30. The resilient lock pieces 25 for holding the retainer 20 in the mounted state in the housing 10 by being locked to the housing 10 are formed on the base end of the retainer 20 in the mounting direction into the housing 10. Further, the slide-contacts 28 extending in parallel to the mounting direction of the retainer 20 are formed on the tip side of the retainer 20 in the mounting direction. On the other hand, the housing 10 is formed with the guides 16 that extend parallel with the mounting direction of the retainer 20 and slidably contact the slide-contacts 28.

According to this configuration, in the process of mounting the retainer 20 into the housing 10, the slide-contacts 28 slide in contact with the guides 16 for reliably restricting a vertical inclination of the retainer 20. This direction in which the inclination of the retainer 20 is restricted is parallel to the direction in which the resilient lock pieces 25 are spaced apart. Thus, the resilient locks 25 and the housing 10 will not be locked incorrectly to each other due to inclination of the retainer 20. Further, the slide-contacts 28 and the resilient locks 25 are arranged at mutually different positions in the mounting direction (tip end side and base end part of the retainer 20 in the mounting direction). Thus, a degree of design freedom is high in forming the slide-contacts 28 and the resilient locks 25.

The retainer 20 includes the main body 21 formed with the retaining portions 22 for locking the terminal fittings 30 and the operating portion 23 cantilevered in the direction intersecting the mounting direction from the base end of the main body 21. The resilient locks 25 are cantilevered from the operating portion 23 substantially parallel to the mounting direction. Accordingly, if the operating portion 23 is pushed in a correct direction when the resilient lock pieces 25 are locked to the housing 10 in the process of mounting the retainer 20, the resilient locks 25 are kept in correct postures. Thus, the resilient locks 25 can be locked reliably to the locking projections 17L, 17R of the housing 10.

The slide-contacts 28 of the retainer 20 are ribs projecting from the main body 21 and the projecting direction of the slide-contacts 28 is the same direction as the extending direction of the operating portion 23. That is, the operating portion 23 and the slide-contact portions 28 extend toward the same side from the main body 21. Therefore, the retainer 20 can be made smaller as compared with the case where the operating portion 23 and the slide-contacts 28 extend toward opposite sides from the main body 21.

The invention is not limited to the above described and illustrated embodiment. For example, the following embodiments also are included in the scope of the invention.

The slide-contacts are in the projecting ribs and the guide portions are recessed grooves in the above embodiment. However, the slide-contacts may be recessed grooves and the guides may be projecting ribs.

Although two slide-contact portions are provided in the above embodiment, one, three or more slide-contact portions may be provided.

The operating portion intersects the mounting direction of the retainer and the resilient lock pieces extend from the operating portion in the above embodiment. However, the resilient locks may project from positions different from those on the operating portion.

Although the operating portion is cantilevered from the main body in the above embodiment, it may be formed within the thickness or height of the main body.

Although the operating portion and the slide-contacts extend toward the same side from the main body in the above embodiment, they may extend toward opposite sides from the main body.

What is claimed is:

1. An electrical connector, comprising:

a housing with opposite front and rear ends spaced apart in a terminal inserting direction and opposite first and second side surfaces, terminal chambers extending through the housing in the terminal inserting direction, a mounting hole extending from the first side surface toward the second side in a mounting direction intersecting the terminal inserting direction, guide surfaces formed in the mounting hole and extending parallel to the mounting direction and at least one locking projection formed in the mounting hole in proximity to the first side surface;

terminal fittings to be inserted respectively into the terminal chambers;

a long narrow retainer comprising:

a tip configured for insertion into the mounting hole;

a base end opposite the tip;

retaining portions between the tip and the base end and configured to retain the terminal fittings in the terminal chambers;

an operation portion having resilient locks in proximity to the base end of the retainer and configured to engage the locking projection and hold the retainer in the housing; and at least one slide-contact portion between the tip and the resilient locks and extending parallel to a mounting direction of the retainer, wherein slides in contact with the guide surfaces to restrict vertical displacement of the retainer.

2. The connector of claim 1, wherein:

the retainer includes an operating portion cantilevered in a direction intersecting the mounting direction from the base end; and the resilient locks are cantilevered substantially parallel to the mounting direction from the operating portion.

3. The connector of claim 2, wherein:

the at least one slide-contact portion is in the form of at least one rib formed on a side of the retainer from which the operating portion is cantilevered.

4. An electrical connector, comprising:

a housing with terminal chambers extending through the housing in a terminal inserting direction, a mounting hole extending from a first side surface toward a second side in a mounting direction transverse to the terminal inserting direction, guide surfaces formed in the mounting hole and extending parallel to the mounting direction and at least one locking projection formed in the mounting hole in proximity to the first side surface;

a long narrow retainer comprising:

a tip configured for insertion into the mounting hole;

a base end opposite the tip;

an operation portion having resilient locks in proximity to the base end of the retainer and configured to engage the locking projection and hold the retainer in the housing;

at least one slide-contact portion between the tip and the resilient locks and extending parallel to a mounting direction of the retainer, wherein the at least one slide-contact portion slides in contact with the guide surfaces to restrict vertical displacement of the retainer.

5. The connector of claim 4, wherein:

the retainer includes an operating portion cantilevered in a direction intersecting the mounting direction from the base end; and the resilient locks are cantilevered substantially parallel to the mounting direction from the operating portion.

6. The connector of claim 5, wherein:

the at least one slide-contact portion is at least one rib formed on a side of the retainer from which the operating portion is cantilevered.

* * * * *